US007021327B2

(12) United States Patent
Creel

(10) Patent No.: US 7,021,327 B2
(45) Date of Patent: Apr. 4, 2006

(54) HYDRANT VALVE ACCESS SYSTEM

(76) Inventor: John C. Creel, P.O. Box 279, Maupin, OR (US) 97037

( * ) Notice: Subject to any disclaimer, the term of this patent is extended or adjusted under 35 U.S.C. 154(b) by 0 days.

(21) Appl. No.: 10/966,391

(22) Filed: Oct. 14, 2004

(65) Prior Publication Data

US 2005/0103381 A1 May 19, 2005

Related U.S. Application Data

(60) Provisional application No. 60/511,174, filed on Oct. 14, 2003.

(51) Int. Cl.
*E03B 9/02* (2006.01)

(52) U.S. Cl. ..... 137/291; 137/272; 251/293

(58) Field of Classification Search ..... 137/272, 137/290, 291, 292, 293; 251/293, 291
See application file for complete search history.

(56) References Cited

U.S. PATENT DOCUMENTS

| | | | | | |
|---|---|---|---|---|---|
| 107,434 | A * | 9/1870 | Bailey | ..... | 137/291 |
| 2,467,908 | A * | 4/1949 | Rand | ..... | 137/272 |
| 2,693,816 | A * | 11/1954 | Hoelzer | ..... | 137/322 |
| 2,768,642 | A * | 10/1956 | Sherman et al. | ..... | 137/321 |

* cited by examiner

*Primary Examiner*—Kevin Lee
(74) *Attorney, Agent, or Firm*—Kolisch Hartwell, P.C.

(57) ABSTRACT

A system for providing access to a fire hydrant. The system includes an actuator extension having a first end and a second end spaced from the first end. The first end is configured to be mounted on an exterior location on the fire hydrant, so that the first end is operatively engaged with a valve actuator of the fire hydrant, the valve actuator being selectively rotatable to cause a valve of the fire hydrant to open and close. The second end is spaced from the first end and is configured to facilitate application of an externally-applied force and transmission of such force to the first end of the actuator extension.

15 Claims, 2 Drawing Sheets

HYDRANT VALVE ACCESS SYSTEM

CROSS-REFERENCES TO PRIORITY APPLICATION

This application is based upon and claims the benefit under 35 U.S.C. § 119(e) of the following U.S. provisional patent application, which is incorporated herein by reference in its entirety for all purposes: Ser. No. 60/511,174, filed Oct. 14, 2003.

BACKGROUND

Water hydrants, such as those used in firefighting, are often used in emergency situations, and normally it is important that the hydrant be easy to access and operate. Conditions can arise, however, that make it more difficult to access and operate hydrants. In areas that experience significant snowfall, for example, hydrants often become buried under several feet of snow. This can make the hydrant much more difficult to find and use, thus creating a significant hindrance to firefighting efforts. In addition, many other situations can arise where a hydrant is obstructed or is otherwise made difficult to access and operate.

DETAILED DESCRIPTION

Figure 1:
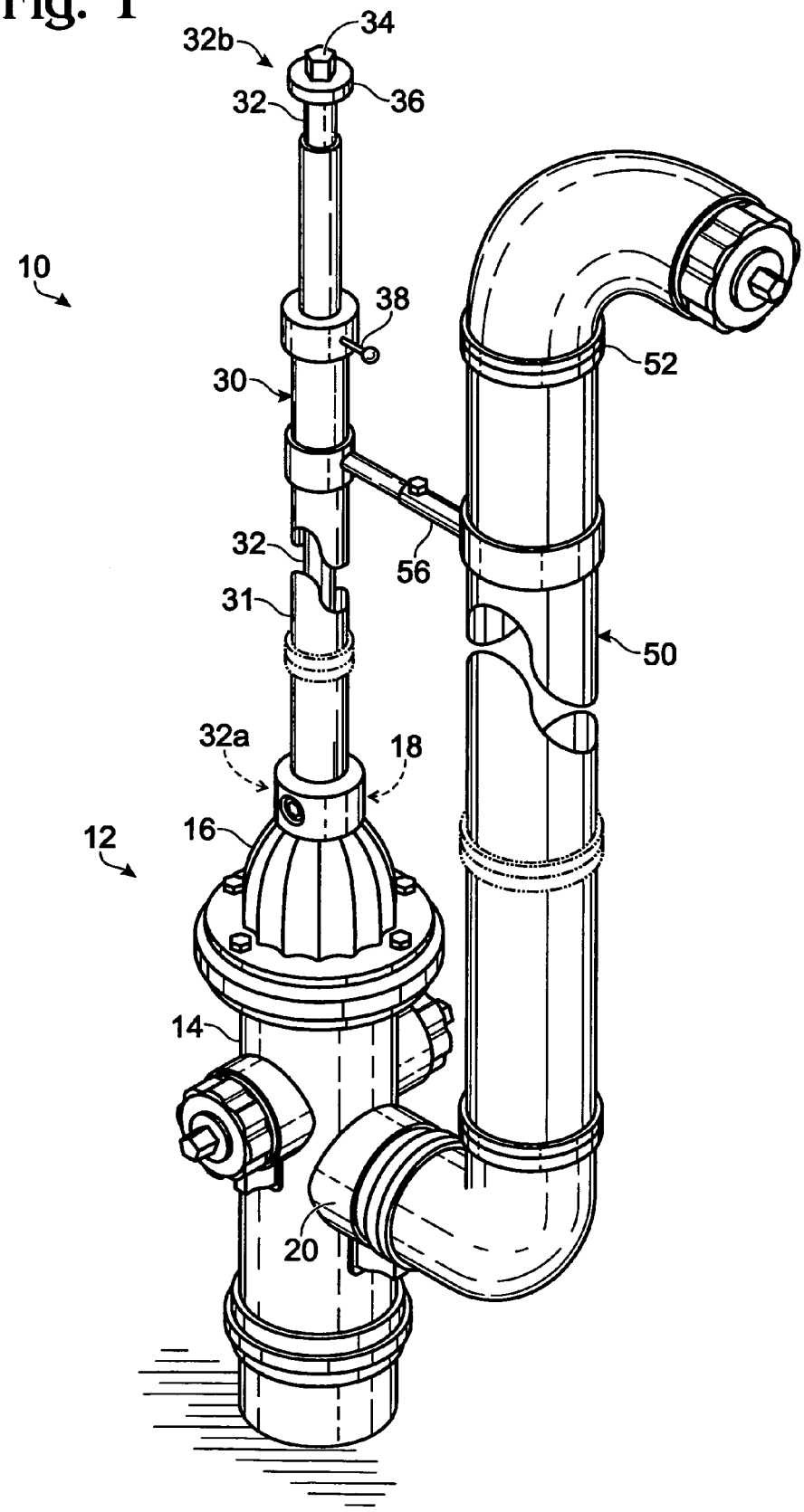
FIGS. 1 and 2 depict an example of a hydrant access system and method according to the present description, which enables access to and operation of a buried hydrant.
Figure 2:
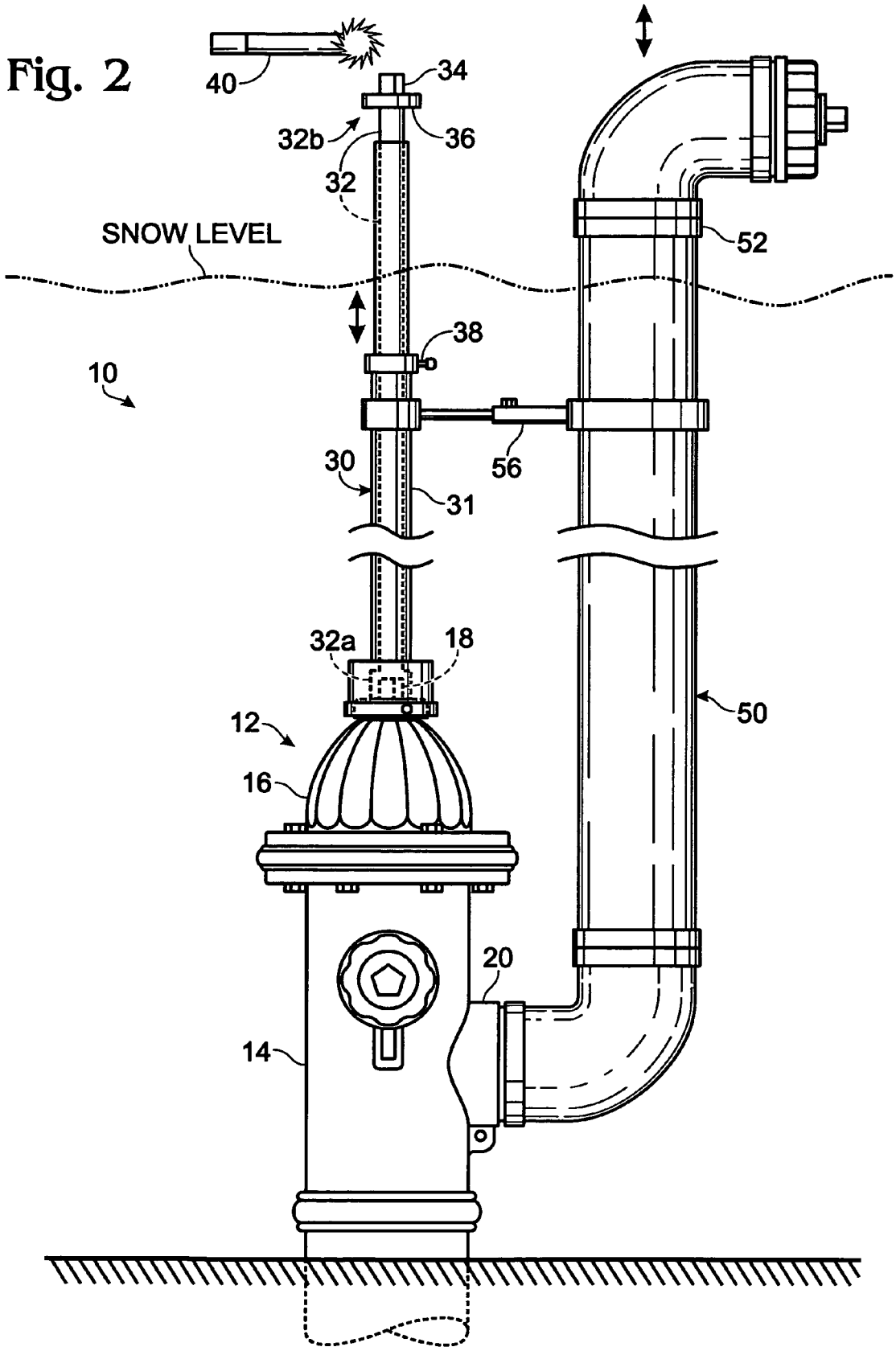

FIG. 1 depicts an exemplary hydrant access system 10 and method. Hydrant 12 is a conventional water hydrant, and includes a valve mechanism 14 within hydrant body 16. A valve actuator typically is provided in an exterior location such as at the top of hydrant body 16, and often is in the form of a rotatable nut or bolt 18. Selective operation of the valve actuator causes valve mechanism 14 to open and close, thereby enabling water to selectively flow out of hydrant outlet 20.

It will be appreciated that hydrant 12 cannot normally be operated if buried under snow, water, dirt, etc. In areas that experience significant snow accumulation, buried hydrants can be difficult to locate and operate. During times of repeated snowfall, hydrants may need to be repeatedly dug out so as to enable access to valve actuator 18 and hydrant outlet 20. Plowing can further complicate hydrant access, by adding dense layers of snow over the top of the hydrant.

Accordingly, the exemplary depicted system may include additional components configured to facilitate access to and operation of buried hydrants. Typically, the system is configured so as to allow the valve actuator of the hydrant to be operated from a location spaced from the hydrant, which often is above the hydrant. Additionally, or alternatively, the system may be configured to allow for attachment of a water hose at a location above or otherwise spaced from the hydrant. Specifically, an actuator extension 30 may be provided to facilitate operation of valve actuator 18 from a remote location. Typically, as in the depicted example, the remote location will be directly above the hydrant body, and will be spaced appropriately depending on the extent to which the hydrant is buried.

Exemplary extension 30 may include a riser conduit 31 and a torque linkage, such as extension rod 32, extending through the conduit. A lower, or proximal, end 32*a* of rod 32 may be operatively engaged with actuator 18, while upper, or distal, end 32*b* may be provided with an operating nut 34 mounted on wrench platform 36, or with some other torque-receiving member or device. Rod 32 thus provides an operative torque-transmitting linkage between nut 34 and nut 18, allowing valve mechanism 14 to be opened and closed by rotating nut 34 (e.g., via an external torque or force applied with a wrench or like tool). Rod 32 and conduit 31 may be provided in any desired length, and/or may be made adjustable. In the depicted example, adjustability of conduit 31 is achieved by providing two telescopically interfitting pieces that are secured with extension pin 38.

As shown, a flare 40 may be provided to provide heat and thereby guard against freezing of moving parts. Indeed, it may be desirable in some cases to form riser 32 as an at least partly hollow member, so that a flare or other source of heat may be inserted and placed in proximity to actuator 18.

As shown in the exemplary system, hydrant outlet 20 may also be fitted with an outlet extension 50, to allow delivery of water to a point above the snow level. Extension 50 may be formed as a single unitary piece or, as shown, from multiple pipe sections secured together, such as with coupling 52. Typically, it will be desirable that extension 50 be made adjustable, to accommodate various snow levels. Additionally, or alternatively, modular pipe sections of different lengths may be employed to accommodate varying burial depths. Outlet extension 50 may be provided with a pressure valve or other like mechanism to allow liquid to drain from extension 50 after use of the hydrant, for example to prevent accumulation of frozen water during cold temperatures.

It should be appreciated that the extension components may be fabricated from a variety of different materials, such as PVC piping, galvanized steel and the like, and may be formed to have any practicable length or other dimension, as appropriate to a given setting. Furthermore, it will often be desirable to provide a stabilizing structure (e.g., structure 56) between the two extensions in order to provide added structural support.

While the present embodiments and method implementations have been particularly shown and described, those skilled in the art will understand that many variations may be made therein without departing from the spirit and scope of the invention. The description should be understood to include all novel and non-obvious combinations of elements described herein, and claims may be presented in this or a later application to any novel and non-obvious combination of these elements. Where claims recite "a" or "a first" element or the equivalent thereof, such claims should be understood to include incorporation of one or more such elements, neither requiring nor excluding two or more such elements.

What is claimed is:

1. A fire hydrant access system, comprising:

an actuator extension configured to be operatively engaged with a valve actuator of a fire hydrant, the valve actuator being disposed on an exterior location on the fire hydrant and operable to actuate a valve mechanism within the fire hydrant so as to selectively open and close a valve of the fire hydrant, the actuator extension including:

a proximal end configured to be engaged with the valve actuator; and a distal end spaced from and disposed remotely from the proximal end, the distal end including a torque-receiving member configured to receive an externally-applied torque, where the actuator extension is configured so that application of torque to the distal end of the actuator extension causes torque to be imparted to the proximal end, thereby imparting torque to the valve actuator, enabling a user to operate the valve actuator without having to directly access the valve actuator at the exterior location on the fire hydrant; and where the actuator extension includes a conduit and a torque linkage disposed within the conduit, the torque-receiving member being disposed at one end of the torque linkage and the linkage having a second end configured to be operatively engaged with the valve actuator of the fire hydrant.

2. The system of claim 1, further comprising an outlet extension configured to be mounted to an outlet of the fire hydrant, to thereby provide a relocated point of attachment for a fire hose.

3. The system of claim 2, where the actuator extension and outlet extension are elongate and configured to enable operation of the valve actuator and attachment of a fire hose at elevated locations above the fire hydrant.

4. The system of claim 3, where portions of the actuator extension and outlet extension are configured to extend vertically upward from the fire hydrant when the actuator extension and outlet extension are installed on the fire hydrant.

5. The system of claim 1, where the conduit has an adjustable length.

6. The system of claim 5, where the conduit includes multiple pieces that may be slid telescopically relative to one another to provide the adjustable length.

7. An apparatus for providing access to, and facilitating operation of a fire hydrant, at an elevated location above the fire hydrant, the apparatus comprising:

an actuator extension, having:

a first end configured to be mounted on an exterior location on the fire hydrant, so that the first end is operatively engaged with a valve actuator of the fire hydrant, the valve actuator being selectively rotatable to cause a valve of the fire hydrant to open and close;

a second end spaced from the first end, the second end being configured to facilitate application of an externally-applied force and transmission of such force to the first end of the actuator extension;

an intermediate portion extending between the first end and second end, and configured so that, when the first end of the actuator extension is mounted on the exterior location, the intermediate portion extends vertically upward away from the fire hydrant, such that the second end is accessible at the elevated location; and where the actuator extension includes a conduit and a torque linkage extending through the conduit.

8. The apparatus of claim 7, where the torque linkage includes:

a torque-receiving portion disposed at and accessible from the second end of the actuator extension, the torque-receiving member being configured to receive the externally-applied force; and an actuator portion located at the first end of the actuator extension and configured to engage the valve actuator to thereby impart torque to the valve actuator, the torque linkage being configured so that torque applied to the torque-receiving portion produces a resultant torque at the actuator portion.

9. The apparatus of claim 8, where the conduit is an elongate tube through which the torque linkage extends.

10. The apparatus of claim 9, where the elongate tube and torque linkage have lengths preselected based on an anticipated burial depth of snow for the fire hydrant.

11. The apparatus of claim 7, further comprising a torque-receiving member located at and accessible from the second end of the actuator extension, the torque-receiving member being configured to receive the externally-applied force.

12. The apparatus of claim 7, further comprising an outlet extension configured to be mounted on an outlet of the fire hydrant, to thereby provide a relocated point of attachment for a fire hose.

13. The apparatus of claim 12, where the actuator extension and outlet extension are elongate and configured to enable operation of the valve actuator and attachment of a fire hose above the fire hydrant.

14. The apparatus of claim 13, where portions of the actuator extension and outlet extension are configured to extend vertically upward from the fire hydrant when the actuator extension and outlet extension are installed on the fire hydrant.

15. An apparatus for providing access to, and facilitating operation of a fire hydrant, at an elevated location above the fire hydrant, the apparatus comprising:

an actuator extension, having:

a first end configured to be mounted on an exterior location on the fire hydrant, so that the first end is operatively engaged with a valve actuator of the fire hydrant, the valve actuator being selectively rotatable to cause a valve of the fire hydrant to open and close;

a second end spaced from the first end, the second end being configured to facilitate application of an externally-applied force and transmission of such force to the first end of the actuator extension;

an intermediate portion extending between the first end and second end, and configured so that, when the first end of the actuator extension is mounted on the exterior location, the intermediate portion extends vertically upward away from the fire hydrant, such that the second end is accessible at the elevated location;

a torque-receiving member located at and accessible from the second end of the actuator extension, the torque-receiving member being configured to receive the externally-applied force; and where the torque-receiving member is a nut.

* * * * *